US007029352B1

(12) United States Patent
Suzuki

(10) Patent No.: US 7,029,352 B1
(45) Date of Patent: Apr. 18, 2006

(54) METHOD FOR FIXING OR REMOVING SURFBOARD FIN

(76) Inventor: Tadashi Suzuki, c/o Goddess International Co., Ltd. 3-9-20 Nakakaigan, Chigasaki City, Kanagawa Prefecture (JP)

( * ) Notice: Subject to any disclaimer, the term of this patent is extended or adjusted under 35 U.S.C. 154(b) by 0 days.

(21) Appl. No.: 11/012,735

(22) Filed: Dec. 16, 2004

(51) Int. Cl.
*B63B 1/00* (2006.01)

(52) U.S. Cl. ..... 441/79; 441/74

(58) Field of Classification Search ..... 441/74, 441/79; 114/127, 140
See application file for complete search history.

(56) References Cited

U.S. PATENT DOCUMENTS 5,176,553 A * 1/1993 Tuttle ..... 441/79
5,934,962 A * 8/1999 Daum et al. ..... 441/79
6,244,921 B1 * 6/2001 Pope ..... 441/79
6,595,817 B1 * 7/2003 Chang ..... 441/79
6,916,220 B1 * 7/2005 Davey et al. ..... 441/79

* cited by examiner

*Primary Examiner*—Lars A. Olson
(74) *Attorney, Agent, or Firm*—Jacobson Holman PLLC

(57) ABSTRACT

A surfboard fin is fixed when it is used, and removed when it is not used. If the fin is not removed when the fin is not used, it produces an inconvenient state during transportation of the surfboard and the like. However, at present, certain screws are used for its fixing or removing. This work requires much amount of labor and a surfboard playing person feels much inconvenience for this work. The present invention provides a method capable of easily fixing a fin to or removing a fin from a surfboard manually. A rectangular groove is formed at the surfboard, a fitting box is embedded into the groove and fixed with adhesive agent. An inner groove is formed at the central part of the box, the inner groove has two protrusions at right side and two protrusions at left side at the side parts. When the fin is set in the inner groove, the two fitting grooves of respective the right and left sides are provided at the legs of the fin, fitted to the protrusions of the inner groove, whereby the fin is fixed. Fixing or removal of the fin can be carried manually in an easy manner. The fin is not removed during its use, but rigidly fixed.

3 Claims, 7 Drawing Sheets

METHOD FOR FIXING OR REMOVING SURFBOARD FIN

BACKGROUND OF THE INVENTION

1. Field of the Invention

This invention relates to a method for fixing or removing a surfboard fin and the like.

2. Description of the Prior Art

A surfboard fin is fixed when it is used, and removed when it is not used because if the fin is not removed when the fin is not used, it produces an inconvenient state during transportation of the surfboard and the like. However, at present, fixing or removing is performed using certain screws. This work requires much amount of labor for it and a surfboard playing person feels much inconvenience for this work. [Patent Document 1] No specific prior art document [Non-patent Document 1]

All the surfboard fins described in a surfing magazine and the like are fixed or removed through screws.

SUMMARY OF THE INVENTION

It is an object of the present invention to provide a method capable of easily fixing a fin to or removing a fin from a surfboard without using any screws manually.

A rectangular groove is formed in a fin, a box having a rectangular shape as seen from a plane is embedded into the groove, then is fixed with adhesive agent, and the fin is put into the rectangular inner groove arranged at the central part of the box.

In the inner groove, two protrusions at right side and two protrusions at left side are provided in a longitudinal direction, and the protrusions are fitted to recess shaped fitting grooves respectively arranged at the two legs of the fin. With the foregoing arrangement, the fin can be fixed to or removed from the surfboard in a manual manner.

Since no screw is used for the method for fixing a fin to or removing a fin from a surfboard and the like, its labor for this work can be remarkably reduced. Since three fins are fixed to one surfboard, the prior art method using screws has been quite troublesome in operation. As the method of the present invention does not use the screws, the fin can be manually and easily fixed or released.

In addition, the groove formed in the surfboard has a rectangular shape, so that it is easier for forming the rectangular groove than making a round groove and the like.

Further, its actual application shows that the fin is not pulled out absolutely in an upward direction. Manual motion of the fin in a rearward direction enables the fin to be easily fitted and fixed to the groove.

BRIEF DESCRIPTION OF THE DRAWING

FIGS. 5(A) to 5(C) are top plan views for showing a fin and a box, wherein FIG. 5(A) shows a left side fin, FIG. 5(B) shows a central fin, and FIG. 5(C) shows a right side fin, respectively.

DETAILED DESCRIPTION OF THE PREFERRED EMBODIMENTS

Figure 1:
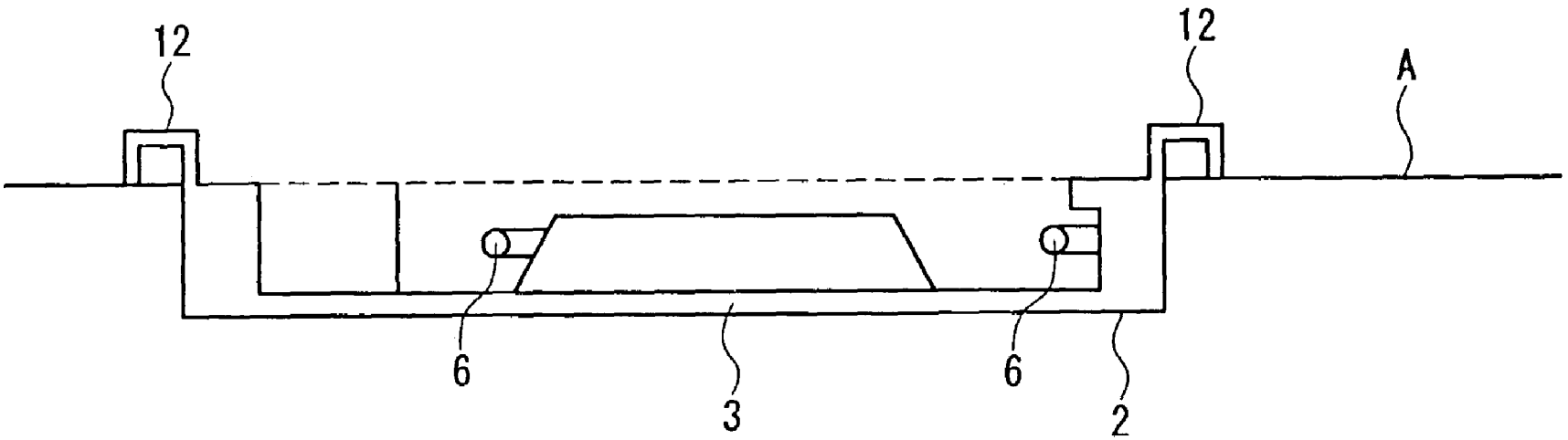
FIG. 1 shows a side elevational view.
Figure 2:
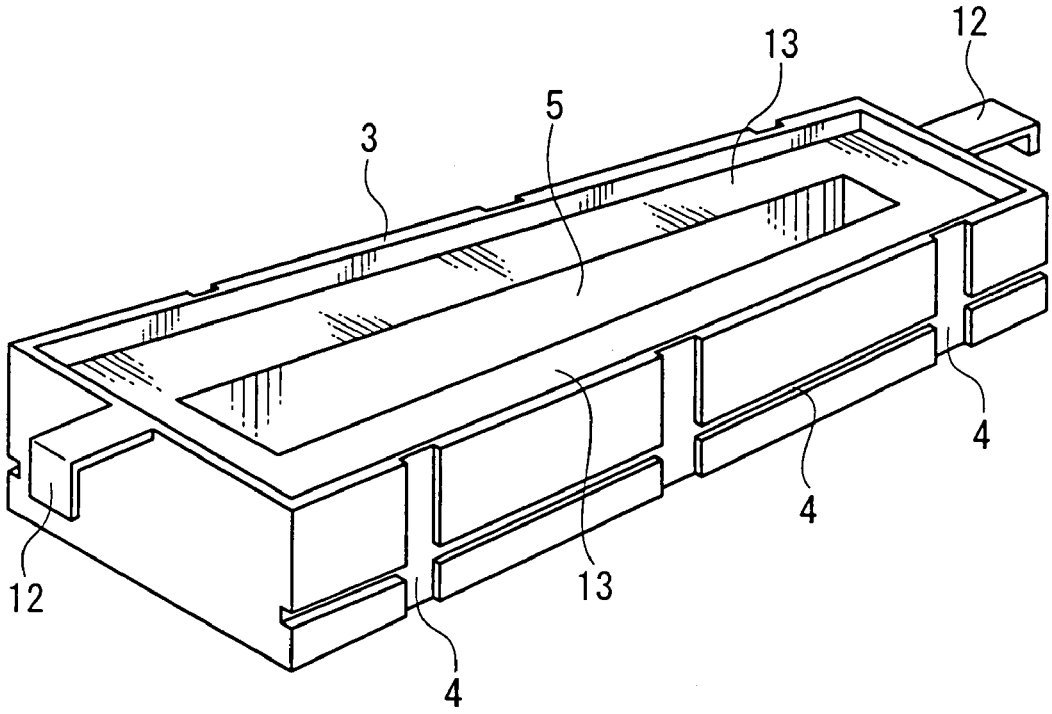
FIG. 2 shows a perspective view.
Figure 3:
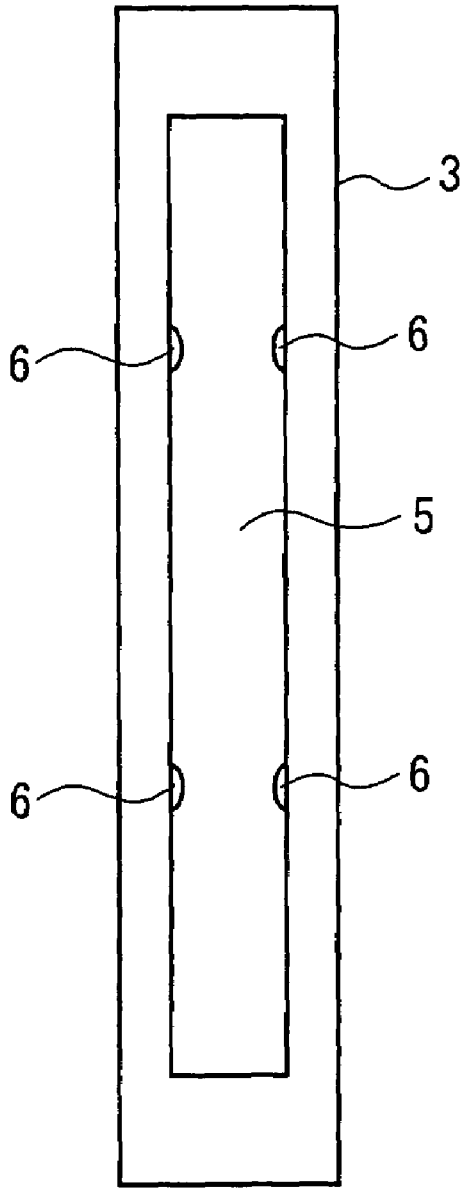
FIG. 3 shows a top plan view of a box.
Figure 4:
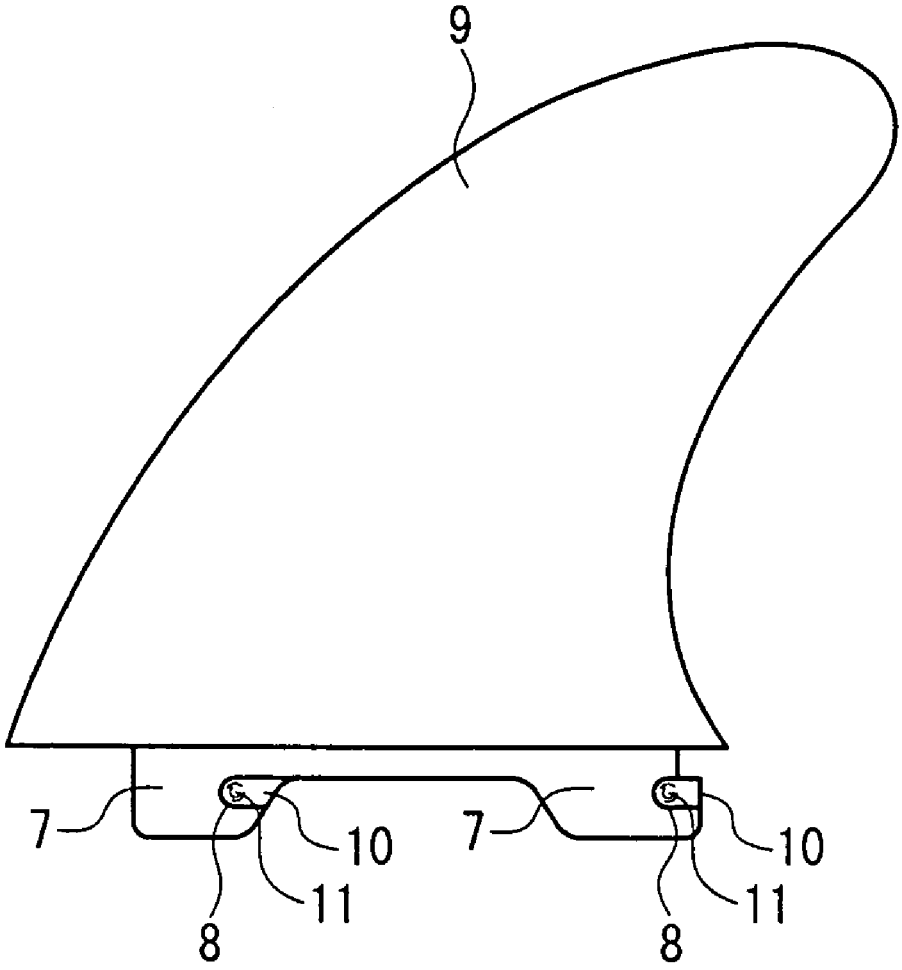
FIG. 4 shows a side elevational view of a fin.
Figure 5:
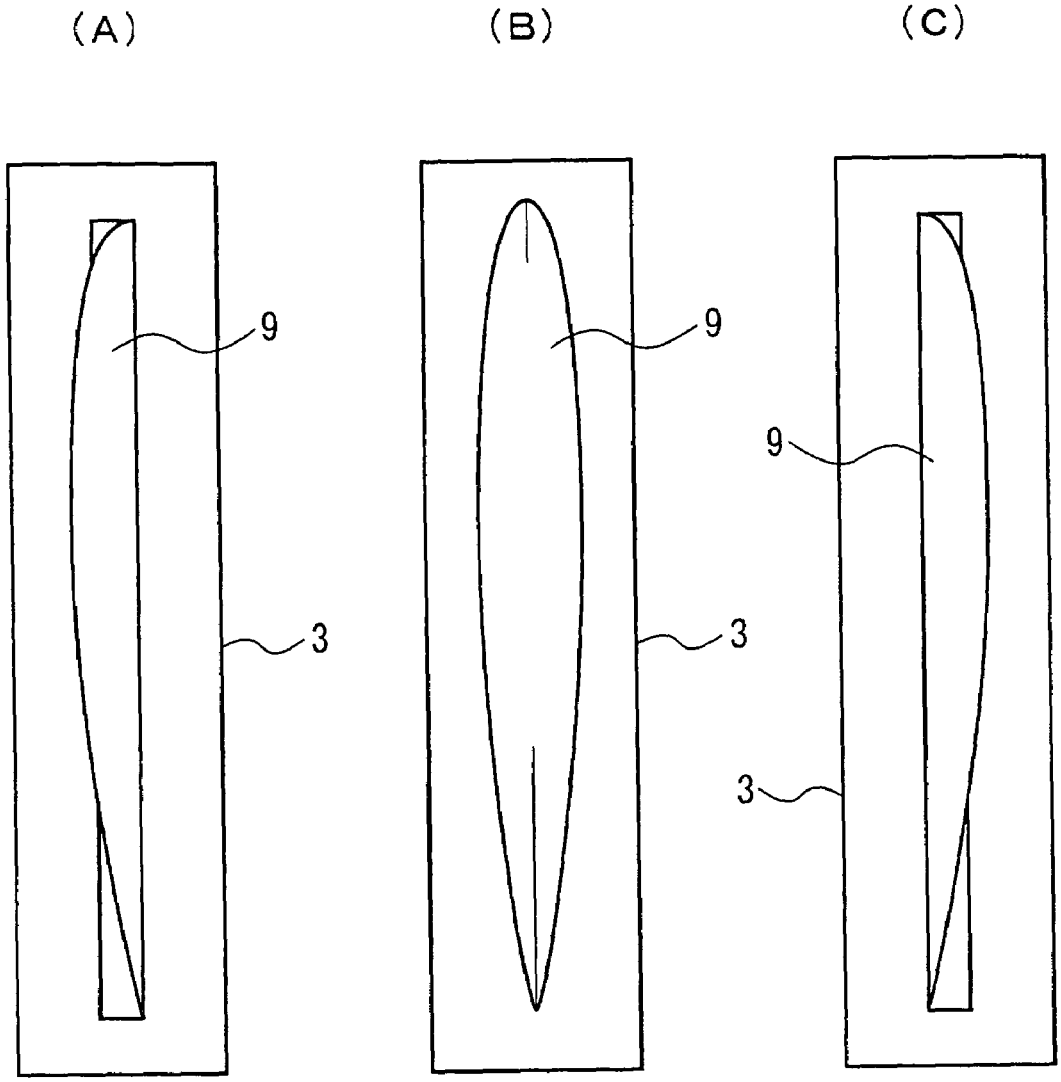
Figure 6:
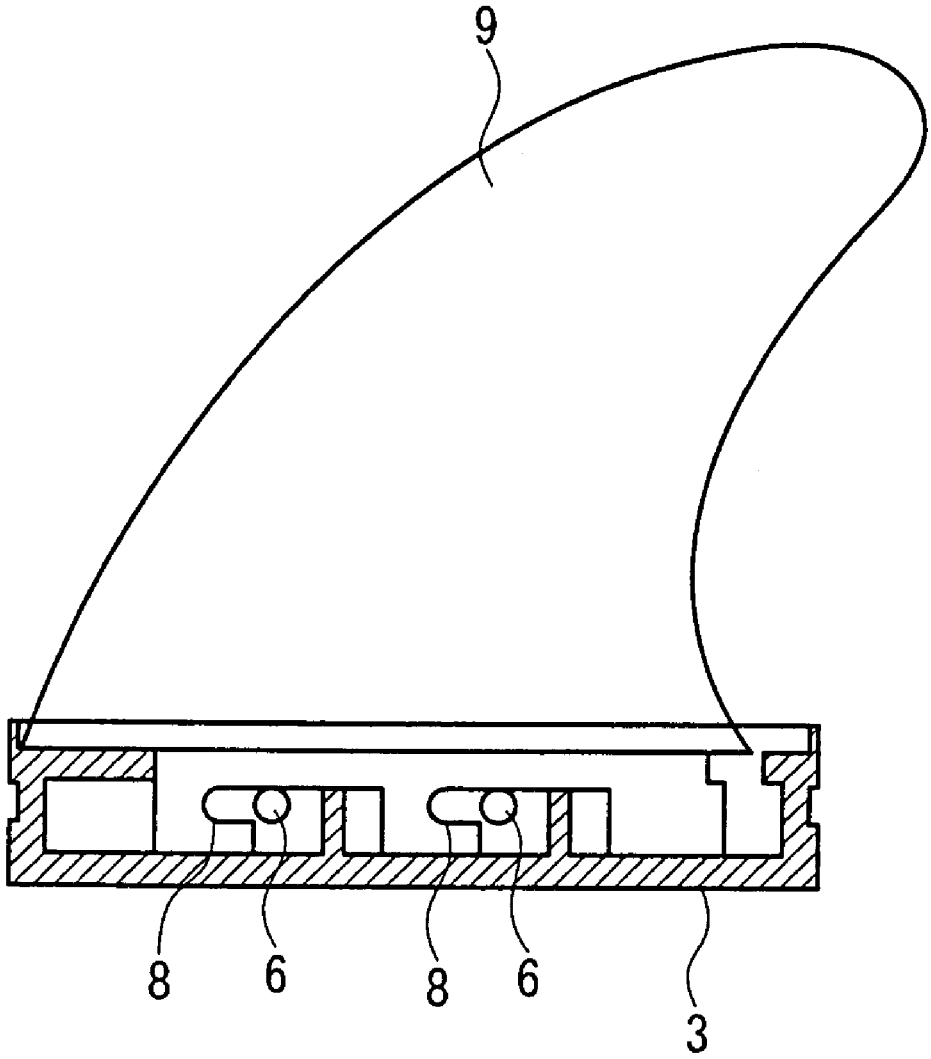
FIG. 6 shows a side elevational view of a fin before its fixing.
Figure 7:
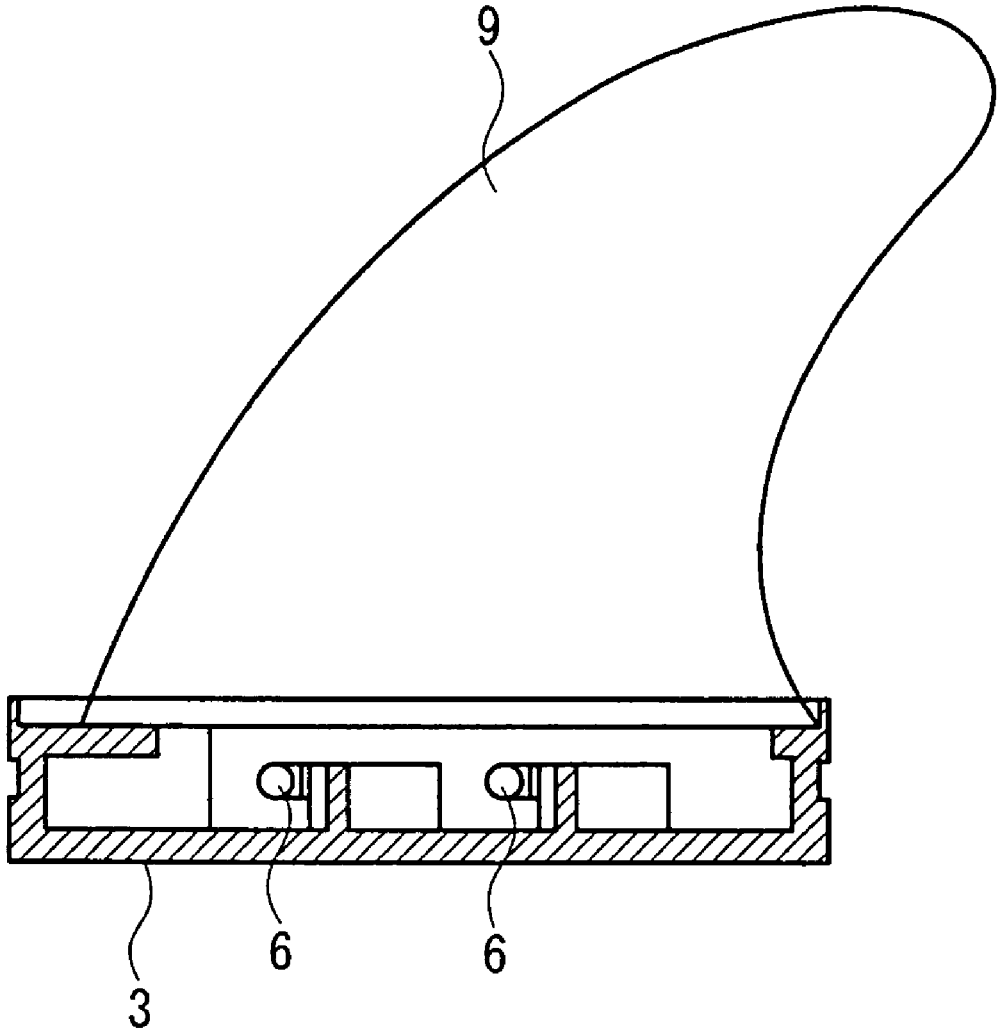
FIG. 7 shows a side elevational view of a fin after its fixing.

Referring now to the drawings, a preferred embodiment of the present invention will be described in detail.

A longitudinal groove 2 is formed in a surfboard 1. A cubic box 3 having a rectangular shape as seen from above is fitted in and fixed to the groove 2 with adhesive agent. The longitudinal and lateral grooves 4 are arranged at the right and left sides of the box 3 so as to facilitate a superior adhering operation.

An inner groove 5 is formed at the central part of the box 3. A shape of the inner groove 5 is also a longitudinal elongated shape. Two protrusions 6 at right side and two protrusions at left side are provided so as to be projected in the inner groove 5 of the box. Two fitting grooves 8 at right side and two fitting grooves 8 at left side arranged to the legs 7 of the fin are respectively fitted to the protrusions 6 and fixed there.

The fitting grooves 8 are strictly fitted and fixed such that the protrusions of the box are introduced at the guiding parts 10 and the fitting parts 11 for the two legs 7 of the fin 9.

In addition, there are provided horizontal holders 12 across the box. They have a U-shape as seen from a lateral side. With the holders being applied, when the surfaces have a deep depth of the groove, the surfaces of the surfboard may not be in flush with one line. Thus, the surface of the surfboard and the surface of the box are always in flush with one line.

All the portions of the surfboard 1 above the plane A are scraped off afterwards.

Walls 13 are constituted for preventing the resin from entering an inside when the fin is fixed.

In the prior art, the screws have been turned by several times with a screw driver at the three fins and fixed, and other prior art methods have also shown many disadvantages, so that the present invention is an epoch-making technology in the field of the surfboard and can be expected to be widely used in the world.

What is claimed is:

1. A method for fixing or removing a surfboard fin with respect to a surfboard said method comprising the steps of forming a longitudinal and square groove as seen from above in the surfboard, fitting and adhering a longitudinal box to the groove, arranging a longitudinal inner groove in the box, providing protrusions protruded from both sides of the box into the longitudinal inner groove, arranging recess portions on legs of the fin, fitting the fin in the longitudinal inner groove of the box, and sliding the fin rearwardly in the longitudinal inner groove so that the protrusions of the box and the recess portions of the legs of the fin are tightly fitted and fixed together to hold the fin in the longitudinal box.

2. The method for fixing or removing a surfboard fin with respect to a surfboard according to claim 1, wherein two protrusions at a right side and two protrusions at a left side of the box are provided, and two recess portions at a right side and two recess portions at a left side of the legs of the fin are provided.

3. The method for fixing or removing a surfboard fin with respect to a surfboard according to claim 1, wherein horizontal holding units are arranged across the box in such a way that a surface of the box and a surface of the surfboard are flush.

* * * * *